US010343174B2

(12) United States Patent
Nordell

(10) Patent No.: US 10,343,174 B2
(45) Date of Patent: Jul. 9, 2019

(54) ROCK MILL LIFTER

(71) Applicant: Lawrence K Nordell, Bellingham, WA (US)

(72) Inventor: Lawrence K Nordell, Bellingham, WA (US)

( * ) Notice: Subject to any disclaimer, the term of this patent is extended or adjusted under 35 U.S.C. 154(b) by 294 days.

(21) Appl. No.: 15/135,053

(22) Filed: Apr. 21, 2016

(65) Prior Publication Data

US 2016/0310952 A1 Oct. 27, 2016

Related U.S. Application Data

(60) Provisional application No. 62/151,346, filed on Apr. 22, 2015.

(51) Int. Cl.

| | |
|---|---|
| ***B02C 17/00*** | (2006.01) |
| ***B02C 17/22*** | (2006.01) |
| ***B02C 17/18*** | (2006.01) |

(52) U.S. Cl.

CPC ..... *B02C 17/22* (2013.01); *B02C 17/1825* (2013.01)

(58) Field of Classification Search

CPC ..... B02C 17/22; B02C 17/1825
USPC ..... 241/182, 183, 299
See application file for complete search history.

(56) References Cited

U.S. PATENT DOCUMENTS

| | | | | | |
|---|---|---|---|---|---|
| 851,013 | A | * | 4/1907 | Lohnert | B02C 17/22 241/183 |
| 971,153 | A | * | 9/1910 | Sherrerd | B02C 17/22 241/183 |
| 987,850 | A | | 3/1911 | Braddock | |
| 1,130,644 | A | * | 3/1915 | Steinbach | B02C 17/06 241/183 |
| 1,174,160 | A | * | 3/1916 | Jensin | B02C 17/22 241/183 |
| 1,291,008 | A | * | 1/1919 | Jensen | B02C 17/22 241/183 |
| 1,315,025 | A | * | 9/1919 | Lawler | B02C 17/22 241/183 |
| 1,351,793 | A | * | 9/1920 | Schmidt | B02C 17/22 241/183 |
| 1,470,420 | A | * | 10/1923 | Askin | B02C 17/22 241/183 |

(Continued)

FOREIGN PATENT DOCUMENTS

| | | |
|---|---|---|
| RU | 2198030 C2 | 10/2003 |
| SU | 1138006 A | 1/1985 |
| WO | 2009050723 A1 | 4/2009 |

OTHER PUBLICATIONS

International Searching Authority, Written Opinion and International Search Report, PCT/US2016/028640, dated Sep. 8, 2016, 6 pages.

*Primary Examiner* — Faye Francis
(74) *Attorney, Agent, or Firm* — Schacht Law Office, Inc.; Dwayne Rogge

(57) ABSTRACT

Disclosed herein is a rock mill lifter having in one example: a radially outward surface with a radially inward recess having a radially inward surface which is substantially parallel to; a calculated radially outward lift surface of the lifter at a minimum allowed lifter height. The rock mill lifter in one example may further include: a circumferential following surface having; a radially inward recess configured to wear to be; substantially parallel to the radially inward surface of the radially inward recess.

3 Claims, 3 Drawing Sheets

(56) References Cited

U.S. PATENT DOCUMENTS

| | | | | | |
|---|---|---|---|---|---|
| 1,539,237 | A | | 5/1925 | Borcherdt | |
| 1,591,938 | A | * | 7/1926 | Harrison | B02C 17/22 241/183 |
| 1,741,604 | A | | 12/1929 | Frederick | |
| 1,947,505 | A | * | 2/1934 | Van Pelt | B02C 17/22 241/183 |
| 2,189,711 | A | | 2/1940 | Eigenbrot | |
| 2,993,656 | A | * | 7/1961 | Ratkowski | B02C 17/22 241/170 |
| 3,078,049 | A | | 2/1963 | Hardinge | |
| 3,206,128 | A | | 9/1965 | MacPherson et al. | |
| 3,404,846 | A | | 10/1968 | MacPherson et al. | |
| 3,580,520 | A | | 5/1971 | Leroy | |
| 3,865,541 | A | | 2/1975 | Burwell et al. | |
| 4,136,832 | A | | 1/1979 | Morita et al. | |
| 4,176,799 | A | | 12/1979 | Clin et al. | |
| 4,194,710 | A | | 3/1980 | Ebner | |
| 4,200,242 | A | | 4/1980 | Ueda | |
| 4,211,369 | A | | 7/1980 | Eigner | |
| 4,243,182 | A | | 1/1981 | Dugger, Jr. | |
| 1,289,279 | A | | 9/1981 | Brandt | |
| 4,373,675 | A | | 2/1983 | Kaufman | |
| 4,389,020 | A | | 6/1983 | Clin et al. | |
| 4,424,938 | A | | 1/1984 | Day | |
| 4,580,734 | A | | 4/1986 | Eroskey et al. | |
| 4,635,860 | A | | 1/1987 | Kruyer | |
| 5,752,665 | A | | 5/1998 | Wason | |
| 5,839,490 | A | * | 11/1998 | Kiedaisch | B02C 17/225 144/208.9 |
| 6,206,310 | B1 | | 3/2001 | Schneider | |
| 7,497,395 | B2 | | 3/2009 | Nordell | |

* cited by examiner

ROCK MILL LIFTER

BACKGROUND OF THE DISCLOSURE

Field of the Disclosure

This application relates to the field of rock grinding or comminution mills in which a liner includes lifters for distributing the contained material.

Background Art

For many industrial purposes it is necessary to reduce the size of rocks to a much smaller particle size (commonly called "comminution"). For example, the larger rocks may be blasted out of an area such as a hillside, pit or mine, and these larger rocks (sometimes the size of boulders) are then directed into a large rock crusher, which is often the first stage of comminution after blasting. The blasted rock sizes can exceed 1000 mm (>40 inches) in size. The resulting output of the crusher is typically smaller rock that is less than 200 mm (8 inches) in a longest dimension which is then fed to a grinding mill. The grinding mill typically comminutes the crushed rock below 50 mm (2 inches) sized rocks or less.

One known grinding mill comprises a large cylindrical grinding section, rotating along its horizontal axis, which often could have a diameter of as much as ten to forty feet. One such mill is described in U.S. Pat. No. 7,497,395 incorporated herein by reference. The material (rocks), along with water, and/or air, is directed into one end of the continuously rotating grinding section, which comprises various types of lifting ribs positioned axially on the inside surface of the grinding section to carry the rocks upwardly, on its surface, in a curved upwardly directed path within the grinding chamber so that these partially ground rocks tumble (fall) back onto other rocks in the lower part of the chamber (see FIG. 9). Thus, these rocks impact each other and the inner surface of the grinding mill, and are thus fragmented (broken up) into smaller rock fragments. Also, sometimes large iron balls (e.g., two to six inches in diameter) are placed in the grinding chamber to obtain improved results.

It often takes a tremendous amount of power to operate such grinding mills, and also there are other substantial costs involved. There are a number of factors which relate to the effectiveness and the economy of the operation, and the embodiments of the disclosure are directed toward improvements in such mills and the methods employed.

SUMMARY OF THE DISCLOSURE

Disclosed herein is a rock mill lifter comprising: a radially outward surface having; a radially inward recess having a radially inward surface which is substantially parallel to; a calculated radially outward lift surface of the lifter at a minimum allowed lift height.

The rock mill lifter as recited above may further comprise: a circumferential following surface having; a radially inward recess configured to wear to be; substantially parallel to the radially inward surface of the radially inward recess.

DESCRIPTION OF THE PREFERRED EMBODIMENTS

Comminution is defined as the reduction of solid materials from one average particle size to a smaller average particle size. Often this is accomplished by crushing, grinding, cutting, vibrating, or other processes. In geology, comminution occurs naturally during faulting in the upper part of the Earth's crust. In industry, comminution is an important unit operation in mineral processing, ceramics, electronics, and other fields, accomplished with many types of mill. In dentistry, it is the result of mastication of food. In general medicine, it is one of the most traumatic forms of bone fracture.

Within industrial comminution, the purpose of comminution is often to reduce the size and to increase the surface area of solids. It is also used to free useful materials from matrix materials in which they are embedded, such as ore from stone, and to concentrate minerals.

Figure 9:
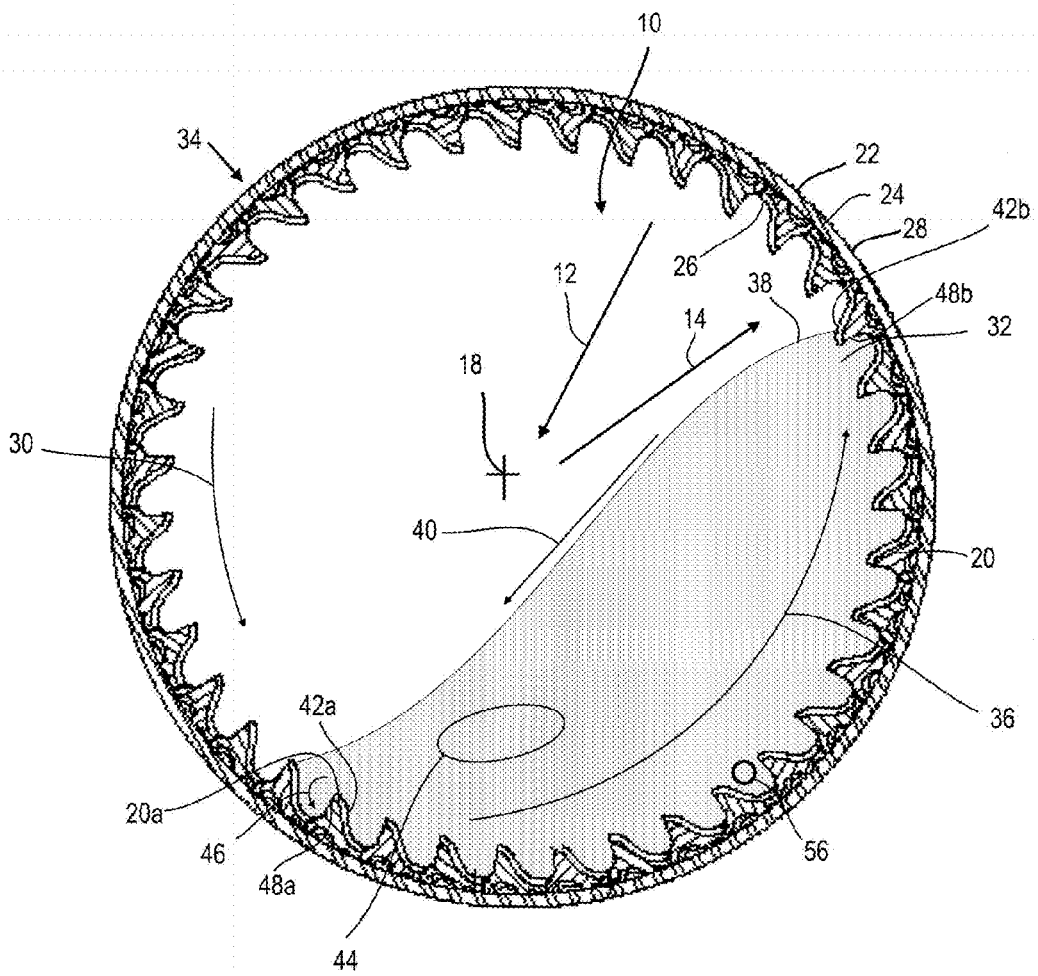
FIG. 9 is a cutaway end view of a rock grinding or comminution mill using the lifter shown in FIG. 1.

Before continuing a detailed description of the examples shown herein, an axes system 10 is disclosed in FIG. 9 including a radially inward axis 12 and a radially outward axis 14. Both of these axes are shown relative to the axis of rotation 18 of the rock commutating mill.

In addition, an alphanumeric labeling system is utilized herein comprising a numeric prefix identifying a general component and an alphabetic suffix denoting particular components. For example, suffixes a and b denote particular components, suffix n denotes a new or unworn component, and suffix w denotes the same component having been worn or used for an extended period of time which modifies the shape or function of the component.

Described herein is a lifter 20 in one example with a particular cross sectional profile, and a method for calculating a recessed region or regions of such lifters 20 minimize the mass of material required to manufacture the lifters 20, and to simultaneously reduce the power consumption of a rock commutating mill using the newly engineered lifters.

FIG. 9 further shows a rock commutating mill 22 generally comprising a cylinder 24 having a concave inner surface 26 and a convex outer surface 28. This cylinder 24 is centered on the horizontal axis of rotation 18 and rotates thereabout. In one example, the cylinder 24 rotates in a unidirectional manner about direction of rotation 30. In another example, the cylinder 24 rotates in a bidirectional manner, first in direction of rotation 30, and then opposite thereto in an oscillating manner. As material 32 (rock) is input 34 into the cylinder 24, it will generally travel in direction of flow 36 to a crest 38. At this crest 38, some of the rock 32 will flow or slide in direction of slide flow 40 and may impact the lift surface 42*a* of a lifter 20*a*. During said slide 40, as well as during said impact with the lift surface 42*a*, compressive and impact forces will tend to fracture and or break the rock 32 into smaller pieces, which is one intended result of the mill 22. In addition, computer modeling and testing has shown that a region of highest comminution 44 exists where relative movement of individual rocks 32 and the pressure of rock there above will maximize comminution.

During comminution, as the lift surfaces 42 of each lifter 20 impact rock and lift rock 32 toward the crest 38, the lift surfaces 42 of each lifter 20 will tend to wear down. In addition, during comminution, eddies 46 in the rock flow 40 form which may cause rock 32 to impact and or abrade following surfaces 48 of the lifters 20. In some comminution operations, "balls" 56 (shown larger for illustration) made of steel or other hard material may be added to the rock 32 to further increase or improve comminution. These balls 56 have been known to further negatively affect the wear life of the lifters 20.

Overall, it has been found desirable to remove and replace the lifters 20 at or before end of life. One such manner of replacement is generally described in U.S. Pat. No. 7,497,395 wherein the current disclosure, individual lifters or a plurality of lifters may be removed from the inner surface 26 of the cylinder 24 and replaced with new, unworn lifters. Such replacement is accomplished by way of removing bolts 50 and 52 shown in FIG. 1 passing through surfaces defining voids 54 and 56 in each lifter 20. The bolts 50 and 52 may then be threaded into the cylinder 24 or otherwise attached thereto.

Figure 1:
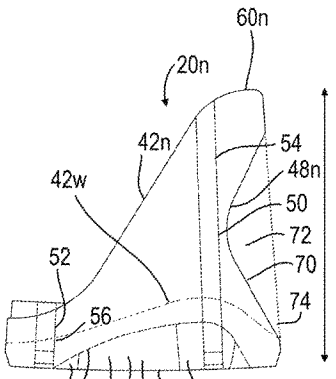
FIG. 1 is a hidden line end view of one example of a new and unworn lifter to be used in a rock grinding or comminution mill.
Figure 6:
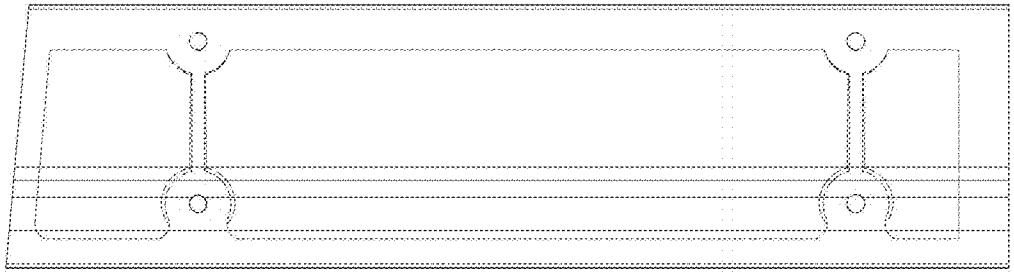
FIG. 6 is a hidden line top view of the example shown in FIG. 5
Figure 7:
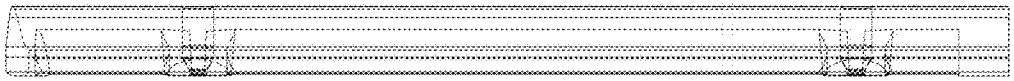
FIG. 7 is a hidden line front view of the example shown in FIG. 5.
Figure 8:
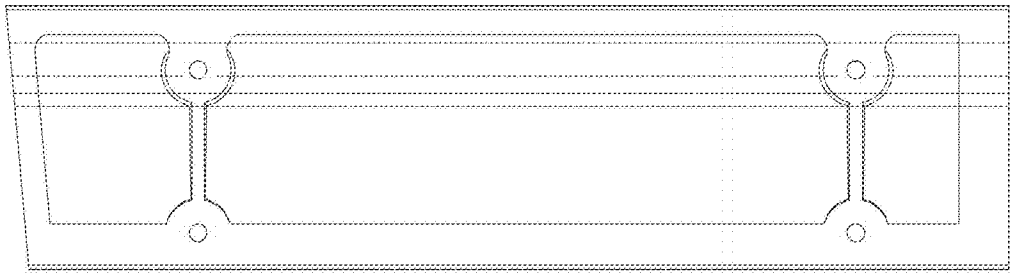
FIG. 8 is a bottom view of the example shown in FIG. 5.
Figure 5:
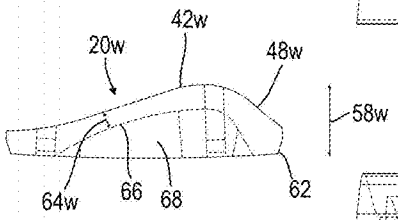
FIG. 5 is a hidden line end view of one example of a worn lifter as shown in FIG. 1 which has been used in a rock grinding or comminution mill.

Looking to FIG. 1 is shown a new lifter 20*n* having a lift surface 42*n* which has not been worn. It can also be seen that the following surface 48*n* also has not been worn. This new lifter 20*n* has a new lifter height 58*n* measured between a radially inward edge 60*n* of the lifter 20*n* land a convex radially outward surface 62 (mill contact surface which contacts the convex inner surface 26 of the cylinder 24. As the lifter 20 is worn, the resultant cross-sectional shape will eventually be as shown in FIG. 5 wherein the worn lift surface 42*w* has a significantly different profile from the new lift surface 42*n* shown in FIG. 1. In addition, it can be seen that the worn lift height 58*w* is substantially smaller than the new or unworn lift height 58*n*. To account for this lift height deterioration, the rotational speed of the mill 22 may be increased to maintain the crest 38 substantially at the same vertical height, to maintain the same comminution rate. However, it can be appreciated that increasing the rotational velocity of the mill 22 requires additional power input (Watts) per mass of rock comminuted (Tons). At some point in wear of the lift surface 42, the Watts/Ton increases to a point where financially the best option is to remove and replace the worn lifters 20*w* with new lifters 20*n*. As this replacement (end of life) is a function of the lifter height 58*w*, and the worn lift surface 42*w*, the shape and relative position of the worn lift surface 42*w* and worn following surface 48*w* may be calculated mathematically and/or through computer modeling. In addition, the required minimum thickness 64*w* given the interior radius of the cylinder 24, material composition of the lifter 20, rotational velocity of the mill 22, hardness and size of the rock 32 to be commuted, and/or minimum Watts/Ton allowed can be calculated. This calculation can then be used to determine an inner surface 66 of a radially inward recess 68 formed in the radially outward surface 62 of the lifter 20 such that as the radially inward surface of the lifter 20 is worn to a final shape as shown in FIG. 5 the thickness 64*w* of the lifter at this region will not exceed the minimum allowed thickness for the combination of factors described above.

In addition to not exceeding a minimum allowable thickness, calculating the wear of lift surface 42*w* allows for the inner surface 66 of the recess 68 to substantially parallel the worn lift surface 42*w*, and thus maximize the amount of material which may be omitted by providing the recess 68.

In addition to not exceeding a minimum allowable thickness, calculating the wear of lift surface 42*w* allows for the inner surface 66 of the recess 68 to substantially parallel the worn lift surface 42*w*, and thus minimize the amount of material which may be omitted by providing the recess 68.

In addition to the recess 68, the following surface 48*n* of each lifter 20 may include a hollowed following surface 70 defining a circumferential following recess 72 circumferentially inward from a line 74 between the radially inward and radially outward size of the following surface 48*n*. As previously discussed, eddies 46 in the comminution flow 36 erode the following surface 48*n* and the radially inward surface 60*n* as well as lift surface 42*n* simultaneously during comminution. Erosion of the surfaces 42 and 48 are factored into the calculation of the worn lift surface 42*w* and therefore is factored into determination of the inner surface 66 of the recess 68.

In one example, 10% to 30% of the mass (metal) of a prior art lifter may be omitted or removed through implementation and maximization of the recesses 68 and/or 72. This reduced weight reduces production material cost, and reduces the overall weight of the mill 222, requiring less energy for comminution.

Figure 2:
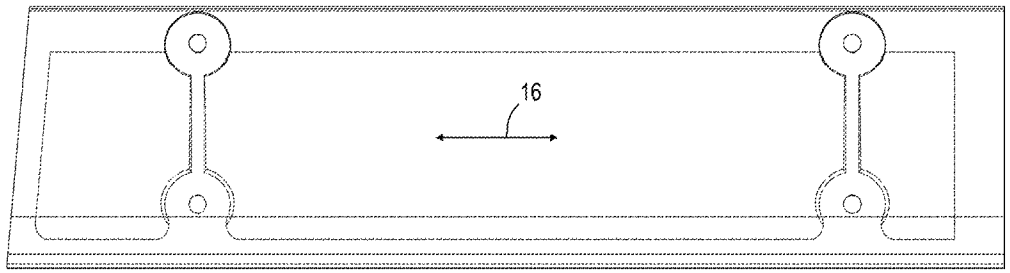
FIG. 2 is a hidden line top view of the example shown in FIG. 1.
Figure 3:
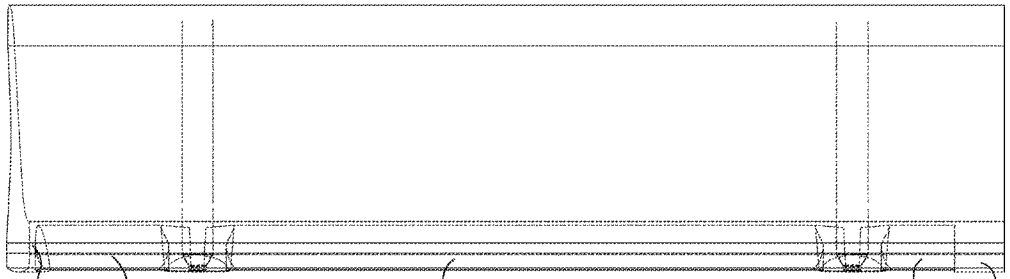
FIG. 3 is a hidden line front view of the example shown in FIG. 1.
Figure 4:
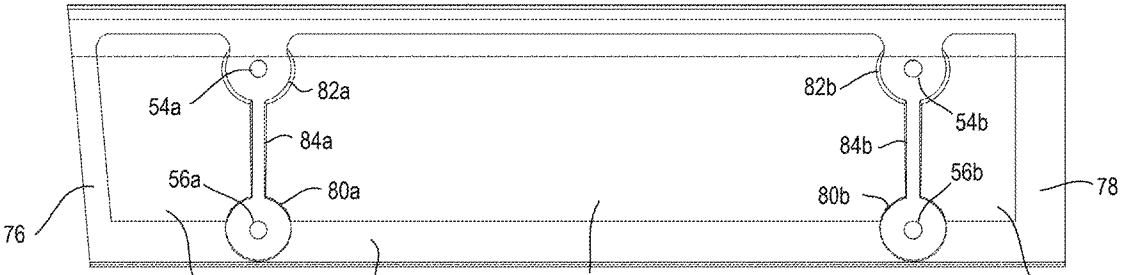
FIG. 4 is a hidden line bottom view of the example shown in FIG. 1.

Looking to the bottom view of FIG. 4 it can be seen that the recess 62 may be divided into first section 62*a*, center section 62*b*, and third section 62*c* outwardly (longitudinally) bounded by and walls 76 and 78. In addition, the first section 62*a* may be separated from center section 62*b* by bosses 80*a* and 82*a*, and also in one example by connecting web 84*a* which connects boss 80*a* and boss 82*a* to provide rigidity and support to the lifter 20*n*. Similarly, center section 62*b* may be separated from third section 62*d* by bosses 80*b* and 82*b*, as well as connecting web 84*b* which connects boss 80*b* and boss 82*b* to provide rigidity and support to the lifter 20*n*. Additional bosses and webs may be provided to improve rigidity and support to the lifter 20*a*.

The bosses 80 and 82 may surround surfaces defining voids 54 and 56 respectively to provide support and rigidity to the attachment system which includes the bolts 50 and 52 passing there through. Without the bosses 80 and 82, a compression load may be extended through the recess 68 which could be detrimental to installation and or operation.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A rock mill lifter configured to be mounted to an inner cylindrical surface of a comminution mill; the rock mill lifter comprising:

a convex mill contact surface configured to be in direct contact with the inner cylindrical surface of the comminution mill;

a lift surface opposing the convex mill contact surface;

a following surface extending between the convex mill contact surface and the lift surface;

the following surface defining a following recess;

the following recess projecting toward the lift surface;

a concave recess formed in the mill contact surface; and the concave recess of the mill contact surface projecting from the convex mill contact surface toward the lift surface.

2. The rock mill lifter as recited in claim 1 further comprising:

surfaces defining voids configured to allow passage of bolts passing through the rock mill lifter to fix the rock mill lifter to the comminution mill;

bosses extending around the surfaces defining voids through which the bolts pass; and wherein the bosses extend through the following recess and extend to the mill contact surface.

3. The rock mill lifter as recited in claim 1 further comprising:

a web extending between adjacent bosses; and wherein the web extends through the following recess to the mill contact surface.

* * * * *